US008272374B2

(12) United States Patent
Cooper

(10) Patent No.: US 8,272,374 B2
(45) Date of Patent: Sep. 25, 2012

(54) BOW STRING SUPPRESSOR

(76) Inventor: Gary L Cooper, Jonesboro, AR (US)

( * ) Notice: Subject to any disclaimer, the term of this patent is extended or adjusted under 35 U.S.C. 154(b) by 371 days.

(21) Appl. No.: 12/263,557

(22) Filed: Nov. 3, 2008

(65) Prior Publication Data

US 2010/0108050 A1 May 6, 2010

(51) Int. Cl.
*F41B 5/20* (2006.01)

(52) U.S. Cl. ..... 124/88; 124/25.6; 124/86; 124/90; 124/92; 267/140; 267/140.3; 267/141

(58) Field of Classification Search ..... 124/25.6, 124/86, 88, 89, 90, 92; 267/140, 140.3, 141
See application file for complete search history.

(56) References Cited

U.S. PATENT DOCUMENTS

| | | | | | |
|---|---|---|---|---|---|
| 3,055,354 | A * | 9/1962 | Gates | 124/88 |
| 3,070,083 | A * | 12/1962 | Gubash | 124/23.1 |
| 4,061,125 | A * | 12/1977 | Trotter | 124/23.1 |
| 4,461,267 | A * | 7/1984 | Simonds et al. | 124/25.6 |
| 4,628,892 | A * | 12/1986 | Windedahl et al. | 124/25.6 |
| 4,662,344 | A * | 5/1987 | Mitchell | 124/22 |
| 4,907,567 | A * | 3/1990 | Henrich | 124/89 |
| 5,146,908 | A * | 9/1992 | Larson | 124/88 |
| 5,205,272 | A * | 4/1993 | Boyer | 124/89 |
| 5,452,704 | A * | 9/1995 | Winebarger | 124/92 |
| 5,720,269 | A * | 2/1998 | Saunders | 124/86 |
| 6,550,467 | B2 * | 4/2003 | Gallops, Jr. | 124/25.6 |
| 6,634,348 | B2 * | 10/2003 | Gallops, Jr. | 124/25.6 |
| 6,715,479 | B1 * | 4/2004 | Bunk | 124/25.6 |
| 6,966,314 | B2 * | 11/2005 | McPherson | 124/89 |
| 7,721,724 | B2 * | 5/2010 | Goade | 124/89 |
| 7,753,044 | B2 * | 7/2010 | Goade | 124/89 |
| 7,793,646 | B2 * | 9/2010 | Cooper et al. | 124/89 |
| 7,954,481 | B2 * | 6/2011 | Barnard | 124/88 |
| 8,011,356 | B2 * | 9/2011 | Gordon et al. | 124/88 |
| 8,033,277 | B2 * | 10/2011 | Gordon et al. | 124/88 |
| 8,056,548 | B1 * | 11/2011 | Larson | 124/89 |
| 2003/0056779 | A1 * | 3/2003 | Gallops, Jr. | 124/89 |
| 2003/0056780 | A1 * | 3/2003 | Gallops, Jr. | 124/92 |
| 2003/0136392 | A1 * | 7/2003 | McPherson | 124/25.6 |
| 2008/0236559 | A1 * | 10/2008 | Barnard | 124/89 |
| 2008/0264400 | A1 * | 10/2008 | Wright | 124/89 |
| 2009/0071458 | A1 * | 3/2009 | Gordon et al. | 124/25.6 |
| 2009/0133683 | A1 * | 5/2009 | Wright | 124/89 |
| 2010/0089375 | A1 * | 4/2010 | Mcpherson et al. | 124/25.6 |
| 2011/0214656 | A1 * | 9/2011 | Saunders | 124/88 |

* cited by examiner

*Primary Examiner* — Gene Kim
*Assistant Examiner* — Alexander Niconovich
(74) *Attorney, Agent, or Firm* — Polster, Lieder, Woodruff & Lucchesi, L.C.

(57) ABSTRACT

A noise reducing bowstring suppression device consisting of an individual length of pliable material supported between dual support members mounted on a bow, a bowstring on the bow contacting the pliable material when the bow is shot.

19 Claims, 1 Drawing Sheet

BOW STRING SUPPRESSOR

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

It is beneficial when bowhunting that the sound of the bow be muted as much as possible so animals aren't startled by the sudden loud noise of the shot, which can be interpreted as a predator pouncing causing the animal to move before the arrow arrives. Using a rubber stop to dampen the vibration of the bowstring is a way to lessen the noise of the shot. However, the solid rubber used in this type of stop has a limited amount of give. Using soft rubber helps reduce a slapping sound. However, the pliability of the material is fragile and of limited durability. Also the bowstring is stopped so abruptly as to change the nock point direction at release, causing the arrow to be thrown off from the desired straight launch.

BRIEF SUMMARY OF THE INVENTION

The present invention consists of a resilient member such as a length of rubber whose ends are attached to prong ends extending from the bow handle. This provides a more resilient means to dampen the vibrations of the bowstring for greater noise reduction, as the resilient member may compress further and rebound quicker than prior art. An important value of the invention is that the resiliency does not immediately stop the bowstring so that the nock point is not suddenly shifted at release, having a detrimental effect on a straight arrow launch.

The foregoing and other objects, features, and advantages of the invention as well as presently preferred embodiments thereof will become more apparent from the reading of the following description in connection with the accompanying drawings.

One object is to provide a bowstring suppression device of greater durability.

Another object is to provide a bowstring suppression device with greater pliability reducing the sound of bowstring contact.

Another object is to provide a bowstring suppression device with greater pliability so that the nock point remains straight.

Another object is to provide a bowstring suppression device with dual flexible supports which move toward the bowstring, absorbing some of the impact of the bowstring reducing noise.

Another object is to provide a bowstring suppression device that is economical to manufacture.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENTS

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
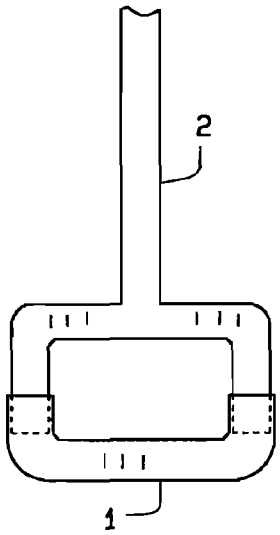
FIG. 1 is a fragmentary top plan view, of one embodiment of bow string suppressor of this invention.

Referring now to FIG. 1, a pliable rubber tube 1 is attached over forked ends of an extending support 2.

Figure 2:
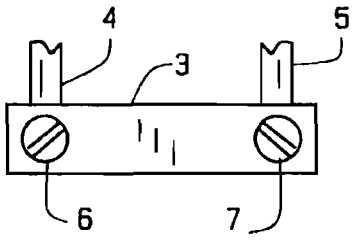
FIG. 2 is a fragmentary plan view of a second embodiment.

Referring to FIG. 2, a flat pliable rubber strip 3 is attached to extending support ends 4 and 5, with screws 6 and 7.

Figure 3:
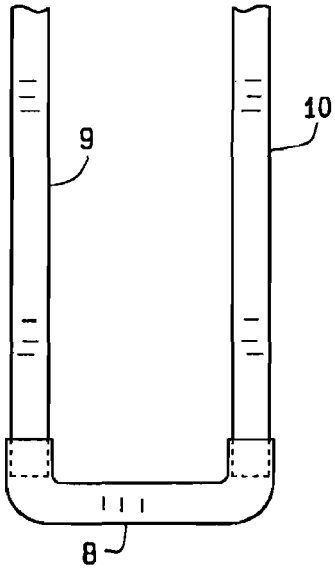
FIG. 3 is a fragmentary plan view of still another embodiment.

Referring to FIG. 3, a pliable rubber tube 8 is attached to separate extending support legs 9 and 10.

Figure 4:
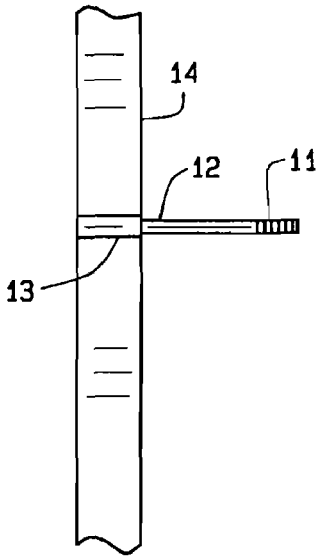
FIG. 4 is a view in side elevation of the bow string suppressor of FIG. 1 or FIG. 3, mounted on a handle of a bow.

Referring now to FIG. 4, a pliable member 11 is attached to extending support 12, which is mounted in cavity 13 of bow handle 14.

Figure 5:
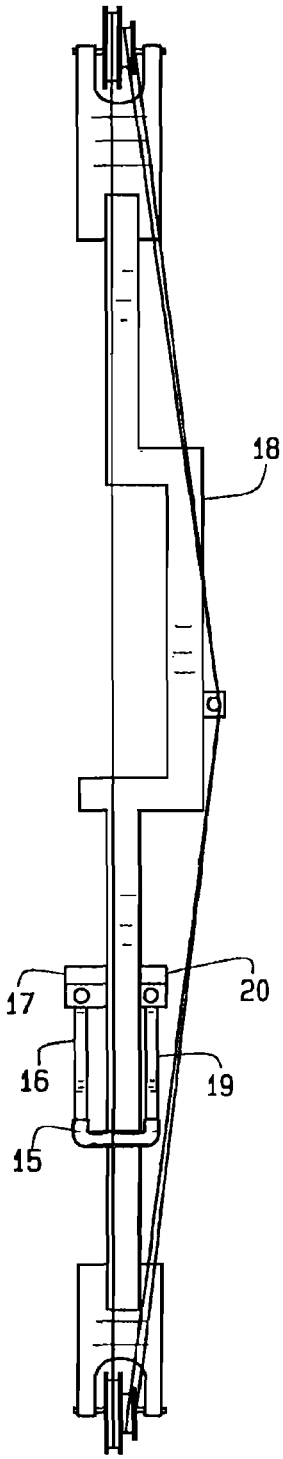
FIG. 5 is a view in side elevation of a compound bow on which a bowstring suppressor of the type shown in FIG. 3 is mounted.

Referring now to FIG. 5, a pliable member 15 is attached to separate extending support legs 16 and 19, connected at their ends opposite the rubber tube 15, to ends 17 and 20 of a cross bar secured in a passage extending through a bow handle 18.

All of these embodiments of FIG. 1 through FIG. 3, are mounted on a bow in such a way that a bowstring strikes the pliable member, preferably in the center of the span of the member, when the bow (an arrow) is shot.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

The invention claimed is:

1. A bowstring suppression device consisting of an extending member with two spaced-apart branches forming a forked end, the extending member being attached to the handle of a bow;

an elongate pliable member having an unsupported span between outer ends of said two spaced-apart branches of said forked end and positioned where a bowstring contacts said span of said pliable member when said bow is shot, one end of said elongate pliable member being attached to one of said branches and the other end of said elongate pliable member being attached to the other of said branches.

2. The bowstring suppression device of claim 1 wherein said pliable member is tube rubber.

3. The bowstring suppression device of claim 1 wherein said pliable member is substantially flat.

4. The bowstring suppression device of claim 1 wherein said pliable member is substantially rounded.

5. The bowstring suppression device of claim 1 wherein the bowstring is located to strike the middle of the pliable member.

6. A bowstring suppression device comprising two spaced, extending members independently attached to a handle of a bow, an elongate pliable member having an unsupported span between said extending members and positioned where a bowstring of said bow contacts said span of said pliable member when said bow is shot, one end of said elongate pliable member being attached to one of said extending members and the other end of said elongate pliable member being attached to the other of said extending members.

7. The bowstring suppression device of claim 6 wherein said pliable member is tube rubber.

8. The bowstring suppression device of claim 6 wherein said pliable member is substantially flat.

9. The bowstring suppression device of claim 6 wherein said pliable member is substantially rounded.

10. The bowstring suppression device of claim 6 wherein the bowstring is located to strike the middle of the pliable member.

11. The bowstring suppression device of claim 6 wherein the two extending members are immobile.

12. The bowstring suppression device of claim 6 wherein the two extending members are flexible.

13. The bowstring suppression device of claim 6 wherein said extending members are connected at their ends opposite the resilient member to a cross bar secured in a passage extending through the bow handle.

14. A bowstring suppression device comprising two spaced-apart, extending members operatively attached to a handle of a bow, and an elongate resilient member having two ends, one end being attached to one of said extending members and the other end being attached to the other of said extending members, the elongate resilient member having an unsupported span between the extending members and being positioned where a bowstring of said bow contacts said span of said resilient member when said bow is shot.

15. The bowstring suppression device of claim 14 wherein said resilient member is a tube, the ends of the tube being fitted over ends of the elongate members.

16. The bowstring suppression device of claim 14 wherein said elongate resilient member is made of rubber.

17. The bowstring suppression device of claim 14 wherein said elongate resilient member comprises a flat strip.

18. The bowstring suppression device of claim 16 wherein ends of said resilient member are attached to said extending members with screws.

19. The bowstring suppression device of claim 14 wherein the bowstring is located to strike the middle of the span of the resilient member.

* * * * *